US011920230B2

(12) United States Patent
Isaza et al.

(10) Patent No.: US 11,920,230 B2
(45) Date of Patent: Mar. 5, 2024

(54) PROCESSING OF IRON COBALT LAMINATION MATERIAL FOR HYBRID TURBO-ELECTRIC COMPONENTS

(71) Applicant: General Electric Company, Schenectady, NY (US)

(72) Inventors: Fabian Isaza, Cincinnati, OH (US); Pablo Gabriel Piazza Galarza, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 57 days.

(21) Appl. No.: 17/407,819

(22) Filed: Aug. 20, 2021

(65) Prior Publication Data

US 2022/0064772 A1 Mar. 3, 2022

Related U.S. Application Data

(60) Provisional application No. 63/072,416, filed on Aug. 31, 2020.

(51) Int. Cl.
*C22F 1/16* (2006.01)
*C22C 30/00* (2006.01)
(Continued)

(52) U.S. Cl.
CPC ..... *C22F 1/16* (2013.01); *C22C 30/00* (2013.01); *C22F 1/02* (2013.01); *C23C 8/02* (2013.01); *C23C 8/12* (2013.01); *C22C 2202/02* (2013.01)

(58) Field of Classification Search
CPC ..... C22F 1/16; C22F 1/02; C22F 1/10; C23C 8/02; C23C 8/12; C23C 8/14;
(Continued)

(56) References Cited

U.S. PATENT DOCUMENTS 3,597,286 A 8/1971 Thornburg
3,695,944 A 10/1972 Stroble
(Continued)

FOREIGN PATENT DOCUMENTS

CN 104008844 A 8/2014
CN 109022701 A 12/2018
CN 111139404 A 5/2020

OTHER PUBLICATIONS

Hiperco, "Hiperco 50hs", Alloy Digest, vol. 47, No. 6, Jun. 1, 1998 (Year: 1998).*

(Continued)

*Primary Examiner* — Nicholas A Wang
*Assistant Examiner* — Maxwell Xavier Duffy
(74) *Attorney, Agent, or Firm* — Dority & Manning, P.A.

(57) ABSTRACT

Methods for processing an iron cobalt alloy, along with components formed therefrom, are provided. The method may include: pre-annealing a sheet of an iron cobalt alloy at a pre-anneal temperature (e.g., about 770° C. to about 805° C.); thereafter, cutting a component from the sheet; thereafter, heat-treat annealing the component at a treatment temperature (e.g., about 845° C. to about 870° C.) for a treatment period (e.g., about 1 minute to about 10 minutes); and thereafter, exposing the component to oxygen at an oxidizing temperature to form an insulation layer on a surface of the component.

17 Claims, 2 Drawing Sheets

(51) Int. Cl.

| | |
|---|---|
| ***C22F 1/02*** | (2006.01) |
| ***C23C 8/02*** | (2006.01) |
| ***C23C 8/12*** | (2006.01) |

(58) Field of Classification Search
CPC ..... C22C 19/07; C22C 38/10; C21D 2261/00; C21D 1/26; C21D 1/30; C21D 1/76; C21D 9/46; C21D 1/74
See application file for complete search history.

(56) References Cited

U.S. PATENT DOCUMENTS

| | | | |
|---|---|---|---|
| 3,793,092 | A | 2/1974 | Fieldler |
| 3,892,604 | A | 7/1975 | Thornburg et al. |
| 3,977,919 | A | 8/1976 | Foster et al. |
| 7,128,790 | B2 | 10/2006 | Waeckerle et al. |
| 7,819,990 | B2 | 10/2010 | Waeckerle et al. |
| 9,862,059 | B2 | 1/2018 | Liebl et al. |
| 2006/0027950 | A1 | 2/2006 | Ishitani et al. |
| 2014/0283953 | A1* | 9/2014 | Waeckerle ..... C22F 1/10 148/310 |
| 2016/0067828 | A1 | 3/2016 | Liebl et al. |
| 2018/0112287 | A1* | 4/2018 | Fitterling ..... B32B 15/011 |
| 2020/0299820 | A1* | 9/2020 | Volbers ..... C22F 1/10 |

OTHER PUBLICATIONS

Alexey Sverdlin, Types of Heat Treating Furnaces, 2014, ASM International, ASM Handbook vol. 4B Steel Heat Treating Technologies, pp. 83-107 (Year: 2014).*

Hailer et al., "Effect of Heat Treatment on Magnetic and Mechanical Properties of an Iron-Cobalt-Vanadium-Niobium Ally", Dec. 3, 2001, 24 pages.

Hiperco, "Hiperco 50hs", Alloy Digest, vol. 47, No. 6, Jun. 1, 1998, p. 22.

Shang et al., "Anisotrophy in magnetic and mechanical properties in textured Hiperco® FeCoV alloys", Journal of Applied Physics, vol. 87, No. 9, American Institute of Physics, New York, May 1, 2000 (Abstract Only).

* cited by examiner

PROCESSING OF IRON COBALT LAMINATION MATERIAL FOR HYBRID TURBO-ELECTRIC COMPONENTS

PRIORITY INFORMATION

The present application claims priority to U.S. Provisional Patent Application 63/072,416 filed on Aug. 31, 2020, which is incorporated by reference herein for all purposes.

FIELD OF TECHNOLOGY

The present disclosure relates generally to processing of iron cobalt (FeCo) magnetic alloys resulting in improved magnetic properties.

BACKGROUND

Fe—Co—V alloys have generally been accepted as the best commercially available alloy for applications requiring high magnetic induction at moderately high fields. V added to 2 wt. % has been found not to cause a significant drop in saturation and yet still inhibit the ordering reaction to such an extent that cold working is possible. However, conventional Fe—Co—V alloys employing less than 2% by weight vanadium have undesirable inherent properties. For example, when the magnetic material undergoes a large magnetic loss the energy efficiency of the magnetic material deteriorates significantly. In addition, conventional Fe—Co—V alloys exhibit certain unsuitable magnetic properties when subjected to rapid current fluctuations. Further, as the percentage of V exceeds 2 wt. %, the DC magnetic properties of the material deteriorate.

In a common form, the composition of Fe—Co—V soft magnetic alloys exhibit a balance between favorable magnetic properties, strength, and resistivity as compared to magnetic pure iron or magnetic silicon steel. These types of alloys are commonly employed in devices where magnetic materials having high saturation magnetic flux density are required. Fe—Co—V alloys have been used in a variety of applications where a high saturation magnetization is required, i.e. as a lamination material for electrical generators used in aircraft and pole tips for high field magnets. Such devices commonly include soft magnetic material having a chemical composition of about 48-52% by weight Co, less than about 2.0% by weight V, incidental impurities and the remainder Fe.

Electric motors currently provide electric power for main engine starting and for in-flight emergency power as well as for normal auxiliary power functions. Typically, such units output electric power from a switched-reluctance starter-generator driven by a shaft supported by magnetic bearings. For example, the starter-generator may be exposed to harsh conditions and environment in which it must function, e.g., rotational speeds of 50,000 to 70,000 rpm and a continuous operating temperature of approximately 500° C. The machine rotor and stator can be composed of stacks of laminations, each of which is approximately 0.006 to 0.008 inches thick. The rotor stack can be approximately 5 inches in length with a diameter of approximately 4.5 inches and the stator outside diameter can be about 9 inches.

For example, Hiperco® alloy 50HS, an alloy produced by Carpenter Technology Corporation, is an iron-cobalt alloy treated according to ASTM A801 Alloy Type 1 that involves heat treating at 1300° F. to 1350° F. (i.e., 704.4° C. to 732.2° C.) for 1 to 2 hours. Alloy 50HS is reported to include, in weight percent, 48.75% Co, 1.90% V, 0.30% Nb, 0.05% Mn, 0.05% Si, 0.01% C, balance Fe. It is reported that Alloy 50HS annealed at 1300° F. exhibits the highest strength while those annealed at 1350° F. produced the lowest strength.

In development of motors, generators and magnetic bearings, it will be necessary to take into consideration mechanical behavior, electrical loss and magnetic properties under conditions of actual use. For rotor applications, these conditions are temperatures above 1000° F. and exposure to alternating magnetic fields of 2 Tesla at frequencies of 500 Hz and the clamping of the rotor will result in large compressive axial loads while rotation of the rotor can create tensile hoop stresses of approximately 85 ksi. Because eddy current losses are inversely proportional to resistivity, the greater the resistivity, the lower the eddy current losses and heat generated. Resistivity data documented for 50HS annealed for 1 hour at temperatures of 1300° F. to 1350° F. indicate a mean room temperature resistivity of about 43 micro-ohm-cm.

Conventional soft magnetic alloys are used widely where high saturation magnetization values are important. However, their yield strengths are low at room temperature, and the strengths are even lower at high temperatures, making the alloys unsuitable for applications such as magnetic parts for jet engines that impose high temperatures and centrifugal stress on materials. Alloy design is critical for aerospace applications and becomes even more difficult when the magnetic requirements are imposed on the material along with the high temperature strength requirements.

As such, improved materials are desired for use in the aerospace field, particularly with respect to room and high temperature strengths and high resistivity of the Fe—Co—V alloys.

BRIEF DESCRIPTION OF THE DRAWINGS

A full and enabling disclosure of the present invention, including the best mode thereof, directed to one of ordinary skill in the art, is set forth in the specification, which makes reference to the appended FIGS., in which.

Figure 1:
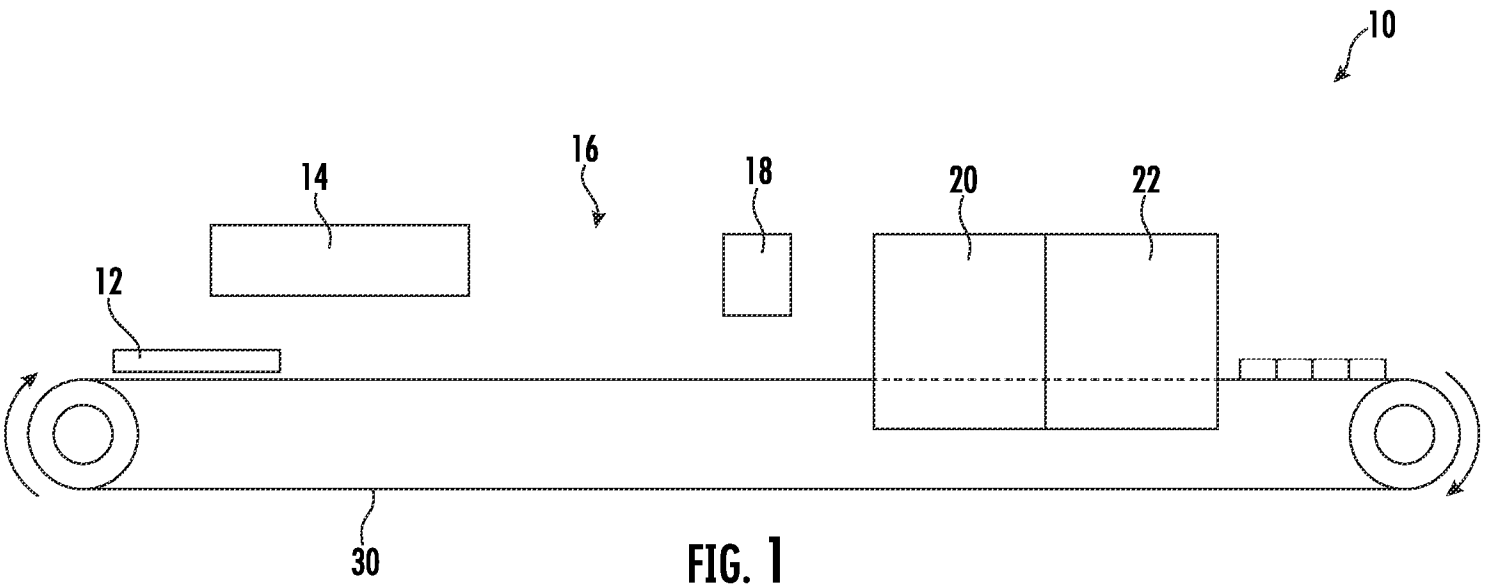
FIG. 1 shows an exemplary system for processing of a sheet of an iron cobalt alloy.

Repeat use of reference characters in the present specification and drawings is intended to represent the same or analogous features or elements of the present invention.

DETAILED DESCRIPTION OF PARTICULAR EMBODIMENTS

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Chemical elements are discussed in the present disclosure using their common chemical abbreviation, such as commonly found on a periodic table of elements. For example, hydrogen is represented by its common chemical abbreviation H; helium is represented by its common chemical abbreviation He; and so forth.

Methods are generally provided for processing an iron cobalt alloy. In one particular embodiment, the iron cobalt alloy includes, in weight percent, about 47.5% to about 50% cobalt (Co), about 1.5% to about 2.25% vanadium (V), about 0.20% to about 0.4% niobium (Nb), about 0.01% to about 0.1% manganese (Mn), about 0.01% to about 0.1% silicon (Si), about 0.001% to about 0.05 carbon (C), and the balance iron (Fe). For example, in one particular embodiment, the iron cobalt alloy includes, in weight percent, 48.75% cobalt (Co), 1.90% vanadium (V), 0.30% niobium (Nb), 0.05% manganese (Mn), 0.05% silicon (Si), 0.01% carbon (C), and the balance iron (Fe). The iron cobalt materials may, in particular embodiments, consist essentially of (e.g., possibly including only incidental impurities in addition to these components) about 47.5% to about 50% cobalt (Co), about 1.5% to about 2.25% vanadium (V), about 0.20% to about 0.4% niobium (Nb), about 0.01% to about 0.1% manganese (Mn), about 0.01% to about 0.1% silicon (Si), about 0.001% to about 0.05 carbon (C), and the balance iron (Fe). For example, in one particular embodiment, the iron cobalt alloy consists essentially of, in weight percent, 48.75% cobalt (Co), 1.90% vanadium (V), 0.30% niobium (Nb), 0.05% manganese (Mn), 0.05% silicon (Si), 0.01% carbon (C), and the balance iron (Fe).

The properties of the iron cobalt alloy are highly sensitive to processing. In one embodiment, the methods may start with a sheet of iron cobalt alloy.

Generally, the methods of processing the iron cobalt alloy includes, in sequential order, pre-annealing, cutting a component from the sheet, heat-treat annealing the component, and exposing the component to oxygen. Referring to FIG. 1, an exemplary system 10 for processing a sheet 12 of an iron cobalt alloy is generally shown. The system 10 includes pre-anneal module 14, a cooling area 16, a cutting module 18, a heat-treat anneal module 20, and an oxidizing module 22. In the embodiment shown, a conveyer 30 is utilized to carry the sheet 12 through each of these modules in a sequential process. However, the system 10 may be formed from modules that are not in a continuous processing system, but another modular system.

Figure 2:
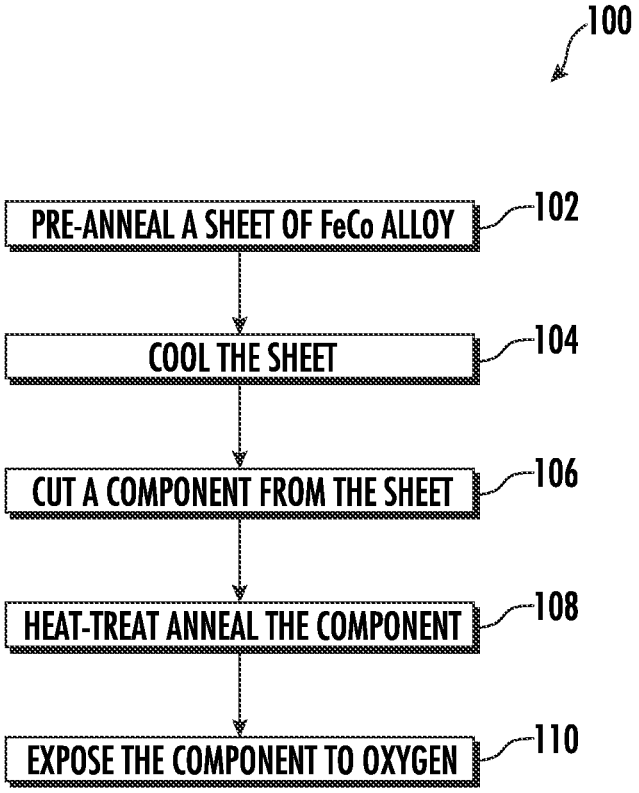
FIG. 2 shows an exemplary method processing of a sheet of an iron cobalt alloy.

In each of these modules, the method of FIG. 2 may be carried out. That is, the method 100 may include pre-annealing the sheet at 102 (e.g., within the pre-anneal module 14 of FIG. 1), cooling the sheet at 104 (e.g., within the cooling area 16 of FIG. 1), cutting a component from the sheet at 106 (e.g., within the cutting module 18 of FIG. 1), heat-treat annealing the component at 108 (e.g., within the heat-treat anneal module 20 of FIG. 1), and exposing the component to oxygen at 110 (e.g., within the oxidizing module 22 of FIG. 1).

Pre-annealing the sheet of the iron cobalt alloy may be performed at a pre-anneal temperature sufficient to address the residual stresses within the untreated sheet. For example, the iron cobalt alloy may be highly isotropic, and a pre-annealing treatment may release pre-stresses within the alloy. For example, the iron cobalt alloy may be heated to a pre-anneal temperature of about 770° C. to about 805° C. (e.g., about 780° C. to about 795° C.). In one embodiment, the pre-annealing treatment may be performed in a pre-anneal atmosphere that includes a reducing agent, such as hydrogen gas. For example, the pre-anneal atmosphere may include of hydrogen and an inert gas (e.g., nitrogen, helium, argon, and/or other noble gasses).

The iron cobalt alloy may be exposed to the pre-anneal temperature under the pre-anneal atmosphere for about 1 minute to about 10 minutes (e.g., about 1 minute to about 5 minutes), before allowing the sheet to cool to room temperature. Without wishing to be bound by any particular theory, it is believed that the sheet may be cooled by simply withdrawing the exposure to the heat source. Due to the alloy being in the form of a relatively thin sheet, the sheet may be cooled to the room temperature quickly without any controlled cooling apparatus or methods. For example, the sheet may be conveyed through an pre-anneal apparatus for pre-annealing at the pre-anneal temperature at a speed sufficient to heat and cool the sheet as desired. For example, the sheet may be conveyed through the pre-anneal apparatus at a rate of about 45 cm/minute to about 65 cm/minutes.

After pre-annealing the sheet, the sheet may be cut into a desired component shape. For example, the sheet may be laser cut, punched, or any other suitable method. In one embodiment, the sheet may be cut into a disk for use in an electric motor.

After cutting the sheet, the sheet may optionally be cleaned using a cleaning agent to remove oils, grease, dirt, or other foreign substances from all component surfaces. Particularly suitable cleaning agents include but are not limited to Petroferm Lenium ES, Calsolve 2370, an aqueous solution of Chem-Crest 2015 Detergent and Chem-Crest 77 Rust Inhibitor or Equivalent.

Thereafter, the component may be heat-treat annealed at a treatment temperature sufficient to produce the desired properties. In one embodiment, the treatment temperature is about 845° C. to about 870° C. (e.g., about 850° C. to about 865° C.). The component for a heat-treat annealing the component at the treatment temperature for the treatment period is performed in a treatment atmosphere, which may include hydrogen. For example, the treatment atmosphere may include of hydrogen and an inert gas (e.g., nitrogen, helium, argon, and/or other noble gasses).

Without wishing to be bound by any particular theory, it is believed that the heat treatment at a relatively high temperature (above the ASTM A801 process) for a relatively short duration (below the ASTM A801 process) in the treatment atmosphere results in the desired properties.

The iron cobalt alloy may be exposed to the treatment temperature for a treatment period of about 10 minutes or less (e.g., about 1 minute to about 10 minutes), such as about 5 minutes or less (e.g., about 1 minute to about 5 minutes), before allowing the sheet to cool to room temperature. Without wishing to be bound by any particular theory, it is believed that the sheet may be cooled by simply withdrawing the exposure to the heat source. Due to the alloy being in the form of a relatively thin sheet, the sheet may be cooled to the room temperature quickly without any controlled cooling apparatus or methods. For example, the sheet may be conveyed through a heat treatment apparatus for pre-annealing at the treatment temperature at a speed sufficient to heat and cool the sheet as desired. For example, the sheet may be conveyed through the treatment apparatus at a rate of about 45 cm/minute to about 65 cm/minutes.

After heat treatment, the component may be exposed to oxygen at an oxidizing temperature to form an insulation layer on a surface of the component. For example, the oxidizing temperature may be about 350° C. to about 370° C. Oxidation may be performed at the oxidizing temperature for an oxidizing period of about 1 hour to about 4 hours (e.g., about 1.5 hours to about 3 hours). The insulated layer generally includes an iron oxide in the form of $FeO_4$ as the insulation layer. For example, the insulation layer may extend into the component from its surface to a depth therein. The oxygen in the oxidizing atmosphere may be provided from air, although pure oxygen or other gases may be used.

The resulting heat-treated sheet of an iron-cobalt alloy has several desired properties resulting from this processing.

Further aspects of the invention are provided by the subject matter of the following clauses:

1. A method of processing an iron cobalt alloy, comprising: pre-annealing a sheet of an iron cobalt alloy at a pre-anneal temperature, wherein the pre-anneal temperature is about 770° C. to about 805° C.; thereafter, cutting a component from the sheet; thereafter, heat-treat annealing the component at a treatment temperature for a treatment period of about 1 minute to about 10 minutes, wherein the treatment temperature is about 845° C. to about 870° C.; and thereafter, exposing the component to oxygen at an oxidizing temperature to form an insulation layer on a surface of the component.
2. The method of any preceding clause, wherein the pre-anneal temperature is about 780° C. to about 795° C.
3. The method of any preceding clause, wherein pre-annealing the sheet of the iron cobalt alloy at the pre-anneal temperature is performed in a pre-anneal atmosphere, and wherein the pre-anneal atmosphere comprises hydrogen.
4. The method of any preceding clause, wherein the pre-anneal atmosphere consists of hydrogen and an inert gas.
5. The method of any preceding clause, wherein the sheet is exposed to the pre-anneal temperature under the pre-anneal atmosphere for about 1 minute to about 10 minutes.
6. The method of any preceding clause, wherein the sheet is exposed to the pre-anneal temperature under the pre-anneal atmosphere for about 1 minute to about 5 minutes.
7. The method of any preceding clause, further comprises: after pre-annealing the sheet and prior to cutting, allowing the sheet to cool to room temperature.
8. The method of any preceding clause, further comprises: after cutting and prior to heat-treat annealing, cleaning the sheet with a cleaning agent.
9. The method of any preceding clause, wherein the treatment period is about 1 minute to about 5 minutes.
10. The method of any preceding clause, wherein heat-treat annealing the component at the treatment temperature for the treatment period is performed in a treatment atmosphere, and wherein the treatment atmosphere comprises hydrogen.
11. The method of any preceding clause, wherein the treatment atmosphere consists of hydrogen and an inert gas.
12. The method of any preceding clause, wherein the treatment temperature is about 850° C. to about 865° C.
13. The method of any preceding clause, wherein the oxidizing temperature is about 350° C. to about 370° C.
14. The method of any preceding clause, wherein the component is exposed to oxygen at the oxidizing temperature for an oxidizing period of about 1 hour to about 4 hours.
15. The method of any preceding clause, wherein the insulation layer comprises FeO4.
16. The method of any preceding clause, wherein the sheet is conveyed through a pre-anneal apparatus for pre-annealing at the pre-anneal temperature, wherein the sheet is conveyed through the pre-anneal apparatus at a rate of about 45 cm/minute to about 65 cm/minutes.
17. The method of any preceding clause, wherein the sheet is conveyed through heat treatment apparatus for heat treat annealing at the treatment temperature, wherein the sheet is conveyed through the heat treatment apparatus at a rate of about 45 cm/minute to about 65 cm/minutes.
18. A heat-treated component of an iron-cobalt alloy formed according to the method of any preceding clause.

This written description uses exemplary embodiments to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of processing an iron cobalt alloy, comprising:

pre-annealing a sheet of an iron cobalt alloy at a pre-anneal temperature, wherein the pre-anneal temperature is about 770° C. to about 805° C. for period between about 1 minute and about 10 minutes;

thereafter, cutting a component from the sheet;

thereafter, heat-treat annealing the component at a treatment temperature for a treatment period of about 1 minute to about 10 minutes, wherein the treatment temperature is about 845° C. to about 870° C.; and thereafter, exposing the component to oxygen at an oxidizing temperature to form an insulation layer on a surface of the component.

2. The method of claim 1, wherein the pre-anneal temperature is about 780° C. to about 795° C.

3. The method of claim 1, wherein pre-annealing the sheet of the iron cobalt alloy at the pre-anneal temperature is performed in a pre-anneal atmosphere, and wherein the pre-anneal atmosphere comprises hydrogen.

4. The method of claim 3, wherein the pre-anneal atmosphere consists of hydrogen and an inert gas.

5. The method of claim 3, wherein the sheet is exposed to the pre-anneal temperature under the pre-anneal atmosphere for about 1 minute to about 5 minutes.

6. The method of claim 1, further comprises:

after pre-annealing the sheet and prior to cutting, allowing the sheet to cool to room temperature.

7. The method of claim 1, further comprises:

after cutting and prior to heat-treat annealing, cleaning the sheet with a cleaning agent.

8. The method of claim 1, wherein the treatment period is about 1 minute to about 5 minutes.

9. The method of claim 1, wherein heat-treat annealing the component at the treatment temperature for the treatment period is performed in a treatment atmosphere, and wherein the treatment atmosphere comprises hydrogen.

10. The method of claim 9, wherein the treatment atmosphere consists of hydrogen and an inert gas.

11. The method of claim 1, wherein the treatment temperature is about 850° C. to about 865° C.

12. The method of claim 1, wherein the oxidizing temperature is about 350° C. to about 370° C.

13. The method of claim 1, wherein the component is exposed to oxygen at the oxidizing temperature for an oxidizing period of about 1 hour to about 4 hours.

14. The method of claim 1, wherein the insulation layer comprises FeO4.

15. The method of claim 1, wherein the sheet is conveyed through a pre-anneal apparatus for pre-annealing at the pre-anneal temperature, wherein the sheet is conveyed through the pre-anneal apparatus at a rate of about 45 cm/minute to about 65 cm/minutes.

16. The method of claim 1, wherein the sheet is conveyed through a heat treatment apparatus for heat treat annealing at the treatment temperature, wherein the sheet is conveyed through the heat treatment apparatus at a rate of about 45 cm/minute to about 65 cm/minutes.

17. A heat-treated component of an iron-cobalt alloy formed according to the method of claim 1.

* * * * *